US006689738B2

(12) United States Patent
Convents et al.

(10) Patent No.: US 6,689,738 B2
(45) Date of Patent: Feb. 10, 2004

(54) OXIDATION PROCESS AND COMPOSITION

(75) Inventors: Daniel Convents, Vlaardingen (NL); Monique Doornink, Vlaardingen (NL); Richard George Smith, Merseyside (GB); David William Thornthwaite, Merseyside (GB)

(73) Assignee: Unilever Home and Personal Care USA Division of Conopco, Inc., Greenwich, CT (US)

( * ) Notice: Subject to any disclaimer, the term of this patent is extended or adjusted under 35 U.S.C. 154(b) by 274 days.

(21) Appl. No.: 10/000,856

(22) Filed: Oct. 24, 2001

(65) Prior Publication Data

US 2002/0119900 A1 Aug. 29, 2002

(30) Foreign Application Priority Data

Oct. 31, 2000 (EP) ..... 00309607
Aug. 9, 2001 (EP) ..... 01306798

(51) Int. Cl.[7] ..... C11D 1/00; C11D 3/26; C11D 3/28

(52) U.S. Cl. ..... 510/500; 510/302; 510/303; 510/311; 510/376; 510/370; 510/499; 510/501

(58) Field of Search ..... 510/302, 303, 510/311, 376, 370, 499, 500, 501; 8/111, 137

(56) References Cited

U.S. PATENT DOCUMENTS

| | | | | |
|---|---|---|---|---|
| 4,077,768 | A | 3/1978 | Johnston et al. | 8/107 |
| 5,605,832 | A | 2/1997 | Damhus et al. | 435/263 |
| 6,384,007 | B1 * | 5/2002 | Convents et al. | 510/392 |

FOREIGN PATENT DOCUMENTS

| | | |
|---|---|---|
| EP | 537 381 | 4/1993 |
| WO | 89/09813 | 10/1989 |
| WO | 98/06812 | 10/1989 |
| WO | 91/05839 | 5/1991 |
| WO | 91/05858 | 5/1991 |
| WO | 92/16634 | 10/1992 |
| WO | 92/18683 | 10/1992 |
| WO | 94/12620 | 6/1994 |
| WO | 95/01426 | 1/1995 |
| WO | 95/07988 | 3/1995 |
| WO | 98/23716 | 6/1998 |
| WO | 98/28400 | 7/1998 |
| WO | 98/51772 | 11/1998 |
| WO | 98/56885 | 12/1998 |
| WO | 98/59108 | 12/1998 |
| WO | 01/34749 | 5/2001 |

OTHER PUBLICATIONS

PCT International Search Report in a PCT application PCT/EP 01/12885.

Derwent Abstract of WO 98/51772—published Nov. 19, 1998.

Co–pending Application: Applicant: Convents et al., Ser. No. 09/709,172, filed: Nov. 9, 2000.

* cited by examiner

*Primary Examiner*—Gregory Delcotto
(74) *Attorney, Agent, or Firm*—Rimma Mitelman

(57) ABSTRACT

There is provided an enzymatic oxidation composition and process wherein an oxidisable substance is reacted with (a) a compound having the formula:

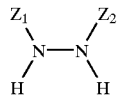

and (b) molecular oxygen, in the absence of peroxidase. The process is useful in detergent compositions for stain bleaching and/or anti dye-transfer.

21 Claims, No Drawings

OXIDATION PROCESS AND COMPOSITION

TECHNICAL FIELD

The present invention generally relates to an oxidation process and composition, especially for laundry bleaching. More in particular, it relates to an oxidation process and composition wherein an oxidisable substance is reacted with molecular oxygen in the presence of a compound which enhances the oxidation reaction.

BACKGROUND AND PRIOR ART

Oxidative and bleaching processes and compositions are widely used, both in industry and in domestic applications. Examples are paper and pulp production, textile industry, water treatment and an many cleaning products in the home, e.g. laundry detergents. Conventional modern detergent compositions for washing fabrics are complex mixtures of ingredients which act to remove soil from the fabric during the washing process.

It is known that a significant improvement in the performance of a detergent compositions can be achieved by the addition of bleaching systems which react chemically with stains present on the fabrics and thereby decolourize the stains. Examples of efficient bleaching systems are tetra acetyl ethylene diamine (TAED)/sodium perborate, and SNOBS.

Although some of these approaches have been successful to a certain extent, there is a continued need for improved or alternative oxidative and bleaching processes and compositions, especially for effective bleach systems, which can be used in cold water and during short wash cycles.

It is therefor an object of the present invention to provide such effective alternative or improved oxidative and bleaching processes and compositions.

We have now surprisingly found that these and other objects can be achieved by using certain hydrazine compounds in combination with molecular oxygen, in the absence of peroxidase.

In the "Enzyme Nomenclature 1978, IUB", Academic Press, New York, San Fransisco, London (1979), peroxidases are classified in class 1.11.1.7. Several applications of peroxidases in oxidative processes have been described. Such applications include, amongst others, stain bleaching and anti dye-transfer in detergents (WO-A-89/09813 and WO-A-91/05839, Novo-Nordisk), polymerization of lignin, in-situ depolymerization of lignin in Kraft pulp, bleaching of denim dyed garments, polymerization of phenolic substances in juices and beverages and hair bleaching (WO-A-92/18683, WO-A-95/07988, WO-A-95/01426).

DEFINITION OF THE INVENTION

According to a first aspect of the invention, there is provided an oxidation process wherein an oxidisable substance is reacted with (a) a compound having the formula:

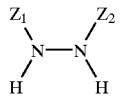

wherein $Z_1$ is any organic group e.g. (substituted)-(hetero)-(polycyclic)-aromatic, substituted (cyclo)-alkyl containing hetero atoms, and $Z_2$ is electron withdrawing group (as described in J. March, 'Advanced Organic Chemistry, pg 17, 3d ed. (1985)), selected from the group consisting of option all y substituted alkyl/(hetero)aryl- -sulfone, -sulfoxide, -sulfonate, -carbonyl, -oxalyl, -amidoxalyl, -hydrazidoxalyl, -carboxyl and esters and salts thereof, -amidyl, -hydrazidyl, nitrile, and (b) molecular oxygen, in the absence of peroxidase.

According to a second aspect, there is provided a composition for stain bleaching and/or anti dye-transfer, comprising (a) a surfactant and (b) a compound having the formula:

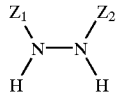

wherein $Z_1$ and $Z_2$ have the meaning given above, said composition being essentially free from peroxidase.

DESCRIPTION OF THE INVENTION

In a first aspect, the invention relates to an enzymatic oxidation process wherein an oxidisable substance is reacted with (a) a specific hydrazine compound and (b) molecular oxygen, in the absence of peroxidase.

The oxidation process can be used within a detergent composition, specifically suited for stain bleaching and/or dye transfer prevention purposes, and this constitutes a second aspect of the invention. The detergent composition may take any suitable physical form, such as a powder, an aqueous or non aqueous liquid, a paste or a gel.

a. The Hydrazine Compound

The novel oxidation process according to the present invention is based on the presence of a specific hydrazine compound. The compounds have the formula:

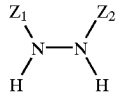

wherein:

wherein $Z_1$ is any organic group e.g. (substituted)-(hetero)-(polycyclic)-aromatic, substituted (cyclo)-alkyl containing hetero atoms, and $Z_2$ is electron withdrawing group (as described in J. March, 'Advanced Organic Chemistry, pg 17, 3d ed. (1985)), selected from the group consisting of optionally substituted alkyl/(hetero)aryl- -sulfone, -sulfoxide, -sulfonate, -carbonyl, -oxalyl, -amidoxalyl, -hydrazidoxalyl, -carboxyl and esters and salts thereof -amidyl, -hydrazidyl, nitrile.

Preferably, the compound has the formula:

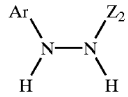

wherein $Z_2$ is as defined before and Ar is an optionally substituted aromatic or heteroaromatic group e.g. phenyl, phenyl substituted with halogen(s), alkoxy, alkyl, (alkyl) amino substituents, pyridinyl, alkyl-pyridinyl, furanyl. Especially preferred compounds have the generic structures:

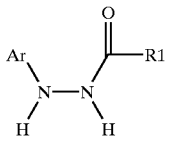

and

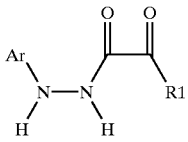

wherein the Ar group is as defined before and R1 is an optionally substituted alkyl, oxyalkyl, aryl, arylhydrazide, arylhydrazine or oxyaryl group.

Of particular interest are derivatives of 2'-phenylbenzohydrazide, having the following structure:

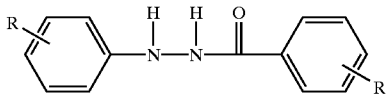

2-phenylhydrazide oxalate, having the following structure:

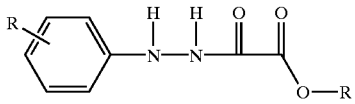

and oxalic acid bis(2-phenylhydrazide), having the following structure:

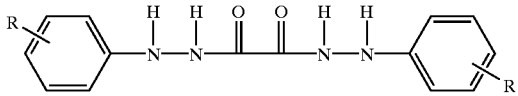

with R representing one or more substitutions independently selected from hydrogen, halogen(s), alkoxy, alkyl, (alkyl) amino, carbonate, carbonate ester, sulphonate, sulfonamide. Examples of such preferred compounds are:

2'-phenylbenzohydrazide
2'-m-tolylbenzohydrazide
2'-p-tolylbenzohydrazide
2'-o-tolylbenzohydrazide
Ethyl[2-(m-tolyl)]hydrazide oxalate
Ethyl[2-(p-tolyl)]hydrazide oxalate
Ethyl[2-(o-tolyl)]hydrazide oxalate
Oxalic acid bis(2-phenylhydrazide)
Oxalic acid bis(2-m-tolylhydrazide)
Oxalic acid bis(2-o-tolylhydrazide)

The compounds used in the present invention can usefully be added to compositions in any suitable form, i.e. the form of a granular composition, a liquid or a slurry of the compound, with a carrier or a coating.

The enzymatic oxidation composition will comprise about 0.1 $\mu$M to 10 mM of the compound, preferably between 1 $\mu$M and 1 mM, most preferably between 10 $\mu$M and 200 $\mu$M.

(b) The Source of Molecular Oxygen

Another ingredient of the bleaching process according to the invention is a source of molecular oxygen. Obviously, the most preferable source of molecular oxygen is air, as this is abundantly available. Alternatively, one may employ a molecular oxygen liberating system. The oxygen-generating system may in principle be chosen from the various oxygen-generating systems which have been disclosed in the art. For example, one may use catalase enzymes, that generate oxygen from hydrogen peroxide.

(c) Peroxidase

The oxidation composition according to the invention is essentially free from peroxidase. A peroxidase is defined for the purpose of this invention as en enzyme having peroxidase activity, i.e. an enzyme capable of catalysing those enzymatic reactions that result in the oxidation of organic compounds, whereby hydrogen peroxide acts as the electron acceptor. Examples of such organic compounds are 2,2'Azinobis(3-ethyl benzo thiazoline-6-sulfonic acid ammonium salt (ABTS), guiacol, syringaldazine, or phenothiazine-10-propionic acid. Suitable examples of peroxidases are the enzymes of EC 1.11.1, in particular any peroxidase comprised by the enzyme classification EC 1.11.1.7; peroxidase fragments exhibiting peroxidase activity, as well as synthetic and semi-synthethic peroxidase derivatives (e.g. pophyrin ring systems), or microperoxidases (see U.S. Pat. No. 4,077,768, EP-A-537 381, WO-A-91/05858 and WO-A92/16634) are also relevant in the context of the invention. Also suitable can be transition metal complexes that display peroxidase activity.

(d) Compositions for Oxidizing Substances

Composition for oxidizing substances can be useful for several industrial applications. The present invention is of particular use for pulp bleaching, water purification, or denim bleaching in the textile industry. Also in hair dyeing formulations, the current composition can be useful. In all those applications, the use of effective bleaching compounds can allow novel and cost-effective industrial processes. The compositions used in the process according to the invention are essentially free from peroxidase.

The oxidation reaction of the present invention is carried out in a liquid medium, preferably an aqueous medium. The oxidation compositions of the invention will comprise less than 0.001 mg of active peroxidase enzyme per liter, preferably less than 0.0001 or 0.00001 mg/l. A detergent composition will comprise less than about 0.001% active peroxidase enzyme (w/w). The peroxidase enzyme activity can be expressed as ABTS (2,2'-azino-bis(3-ethylbenzothiazoline-6-sulphonic acid) units. The peroxidase enzyme activity in the oxidation composition will be less than about 10 ABTS units per liter, preferably less than 1 or 0.1 ABTS units/l.

Of further particular interest are detergent compositions, as described below in more detail.

(e) Detergent Compositions

The detergent compositions of the invention may take any suitable physical form, such as a powder, a tablet, an aqueous or non-aqueous liquid, a paste or a gel. However, granular detergents (powders) are preferred. A detergent composition may comprise the following ingredients, without pretending to be exhaustive:

A. Surfactants

When used to formulate bleaching detergent compositions, the compositions of the invention will contain one or more detergent-active compounds (surfactants) which may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and nonionic compounds. Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulpho-succinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 (and preferably 3 to 7) moles of ethylene oxide per mole of alcohol. Non-ethoxylated nonionic surfactants include alkylpolyglycosides, glycerol monoethers, and polyhydroxy-amides (glucamide). If the detergent composition comprises both nonionic and anionic surfactants, it is preferred that the ratio of nonionic surfactant to anionic surfactant is at least 1 to 3, more preferably at least 1 to 1.

The choice of detergent-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

The total amount of surfactant present will also depend on the intended end use and may be as high as 60% by weight, for example, in a composition for washing fabrics by hand. In compositions for machine washing of fabrics, an amount of from 5 to 40% by weight is generally appropriate. Detergent compositions suitable for use in most automatic fabric washing machines generally contain anionic non-soap surfactant, or nonionic surfactant, or combinations of the two in any ratio, optionally together with soap.

B. Detergency Builders

The bleach compositions of the invention will generally also contain one or more detergency builders. This detergency builder may be any material capable of reducing the level of free calcium ions in the wash liquor and will preferably provide the composition with other beneficial properties such as the generation of an alkaline pH, the suspension of soil removed from the fabric and the suspension of the fabric-softening clay material. The total amount of detergency builder in the compositions will suitably range from 5 to 80%, preferably from 10 to 60% by eight. Inorganic builders that may be present include sodium carbonate, if desired in combination with a crystallisation seed for calcium carbonate, as disclosed in GB-A-1 437 950 (Unilever); crystalline and amorphous aluminosilicates, for example, zeolites as disclosed in GB-A-1 473 201 (Henkel), amorphous aluminosilicates as disclosed in GB-A-1 473 202 (Henkel) and mixed crystalline/amorphous aluminosilicates as disclosed in GB-A-1 470 250 (Procter & Gamble); and layered silicates as disclosed in EP-B-164 (Hacksawed). Inorganic phosphate builders, for example, sodium orthophosphate, pyrophosphate and tripolyphosphate, may also be present, but on environmental grounds those are no longer preferred.

The detergent compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50% by weight. The alkali metal aluminosilicate may be either crystalline or amorphous or mixtures thereof, having the general formula:

$$0.8\text{–}1.5\ Na_2O.\ Al_2O_3.\ 0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB-A-1 429 143 (Proctor & Gamble). The preferred sodium aluminosilicates of this type are the well-known commercially available zeolites A and X, and mixtures thereof. The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP-A-384 070 (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20. Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyl-iminodiacetates, alkyl- and alkenylmalonates and succinates; and sulphonated fatty acid salts.

Especially preferred organic builders are citrates, suitably used in amounts of from 5 to 30% by weight, preferably from 10 to 25% by weight, and acrylic polymers, more especially acrylic/maleic copolymers, suitably used in amounts of from 0.5 to 15%, preferably from 1 to 10% by weight. Builders, both inorganic and organic, are preferably present in the form of their alkali metal salt, especially their sodium salt.

C. Enzymes

The bleaching detergent compositions of the present invention may additionally comprise one or more enzymes, which provide cleaning performance, fabric care and/or sanitation benefits. Such enzymes include oxidoreductases, transferases, hydrolases, lyases, isomerases and ligases. Suitable members of these enzyme classes are described in Enzyme nomenclature 1992: recommendations of the Nomenclature Committee of the International Union of Biochemistry and Molecular Biology on the nomenclature and classification of enzymes, 1992, ISBN 0-12-227165-3, Academic Press. The most recent information on the nomenclature of enzymes is available on the Internet through the ExPASy WWW server (http://www.expasy.ch/)

Examples of the hydrolases are carboxylic ester hydrolase, thiolester hydrolase, phosphoric monoester hydrolase, and phosphoric diester hydrolase which act on the ester bond; glycosidase which acts on O-glycosyl compounds; glycosylase hydrolysing N-glycosyl compounds; thioether hydrolase which acts on the ether bond; and exopeptidases and endopeptidases which act on the peptide bond. Preferable among them are carboxylic ester hydrolase, glycosidase and exo- and endopeptidases. Specific examples of suitable hydrolases include (1) exopeptidases such as aminopeptidase and carboxypeptidase A and B and endopeptidases such as pepsin, pepsin B, chymosin, trypsin, chymotrypsin, elastase, enteropeptidase, cathepsin B, papain, chymopapain, ficain, thrombin, plasmin, renin, subtilisin, aspergillopepsin, collagenase, clostripain, kallikrein, gastricsin, cathepsin D, bromelain, chymotrypsin C, urokinase, cucumisin, oryzin, proteinase K, thermomycolin, thermitase, lactocepin, thermolysin, bacillolysin. Preferred among them is subtilisin; (2) glycosidases such as α-amylase, β-amylase, glucoamylase, isoamylase, cellulase, endo-1,3(4)-β-glucanase (β-glucanase), xylanase, dextranase, polygalacturonase (pectinase), lysozyme, invertase, hyaluronidase, pullulanase, neopullulanase, chitinase, arabinosidase, exocellobiohydrolase, hexosaminidase, mycodextranase, endo-1,4-β-mannanase (hemicellulase), xyloglucanase, endo-β-galactosidase (keratanase), mannanase and other saccharide gum degrading enzymes as described in WO-A-99/09127. Preferred among them are α-amylase and cellulase; (3) carboxylic ester hydrolase including carboxylesterase, lipase, phospholipase, pectinesterase, cholesterol esterase, chlorophyllase, tannase and wax-ester hydrolase. Preferred among them is lipase.

Examples of transferases and ligases are glutathione S-transferase and acid-thiol ligase as described in WO-A-98/59028 and xyloglycan endotransglycosylase as described in WO-A-98/38288.

Examples of lyases are hyaluronate lyase, pectate lyase, chondroitinase, pectin lyase, alginase II. Especially preferred is pectolyase, which is a mixture of pectinase and pectin lyase.

A different process for enhancing the efficacy of the bleaching action of oxidoreductases is by targeting them to stains by using antibodies or antibody fragments as described in WO-A-98/56885. Antibodies can also be added to control enzyme activity as described in WO-A-98/06812.

A preferred combination is a detergent composition comprising of a mixture of conventional detergent enzymes such as protease, amylase, lipase, cutinase and/or cellulase together with one or more plant cell wall degrading enzymes.

Endopeptidases (proteolytic enzymes or proteases) of various qualities and origins and having activity in various pH ranges of from 4–12 are available and can be used in the instant invention. Examples of suitable proteolytic enzymes are the subtilisins, which can be obtained from particular strains of *B. subtilis, B. lentus, B. amyloliquefaciens* and *B. licheniformis,* such as the commercially available subtilisins Savinase™, Alcalase™, Relase™, Kannase™ and Everlase™ as supplied by Novo Industri A/S, Copenhagen, Denmark or Purafect™, PurafectOxP™ and Properase™ as supplied by Genencor International. Chemically or genetically modified variants of these enzymes are included such as described in WO-A-99/02632 pages 12 to 16 and in WO-A-99/20727 and also variants with reduced allergenicity as described in WO-A-99/00489 and WO-A-99/49056.

Suitable lipases include those of bacterial or fungal origin as described in WO-A-99/11770 pages 33, 34, such as the commercially available Lipolase™, Lipolase Ultra™, LipoPrime™, from Novo Nordisk, or Lipomax™ from Genencor. Chemically or genetically modified variants of these enzymes are included.

Suitable amylases include those of bacterial or fungal origin. Chemically or genetically modified variants of these enzymes are included as described in WO-A-99/02632 pages 18, 19. Commercial cellulase are sold under the tradename Purastar™, Purastar OxAm™ (formerly Purafact Ox Am™) by Genencor; Termamyl™, Fungamyl™ and Duramyl™, all available from Novo Nordisk A/S.

Suitable cellulases include those of bacterial or fungal origin. Chemically or genetically modified variants of these enzymes are included as described in WO-A-99/02632 page 17. Particularly useful cellulases are the endoglucanases such as the EGIII from *Trichoderma longibrachiatum* as described in WO-A-94/21801 and the E5 from *Thermomonospora fusca* as described in WO-A-97/20025. Endoglucanases may consist of a catalytic domain and a cellulose binding domain or a catalytic domain only. Preferred cellulolytic enzymes are sold under the tradename Carezyme™, Celluzyme™ and Endolase™ by Novo Nordisk A/S; Puradax™ is sold by Genencor and KAC™ is sold by Kao corporation, Japan.

Detergent enzymes are usually incorporated in an amount of 0.00001% to 2%, and more preferably 0.001% to 0.5%, and even more preferably 0.01% to 0.2% in terms of pure enzyme protein by weight of the composition. Detergent enzymes are commonly employed in the form of granules made of crude enzyme alone or in combination with other components in the detergent composition. Granules of crude enzyme are used in such an amount that the pure enzyme is 0.001 to 50 weight percent in the granules. The granules are used in an amount of 0.002 to 20 and preferably 0.1 to 3 weight percent. Granular forms of detergent enzymes are known as Enzoguard™ granules, prills, marumes or T-granules. Granules can be formulated so as to contain an enzyme protecting agent (e.g. oxidation scavengers) and/or a dissolution retardant material. Other suitable forms of enzymes are liquid forms such as the "L" type liquids from Novo Nordisk, slurries of enzymes in nonionic surfactants such as the "SL" type sold by Novo Nordisk and microencapsulated enzymes marketed by Novo Nordisk under the tradename "LDP" and "CC".

The enzymes can be added as separate single ingredients (prills, granulates, stabilised liquids, etc. containing one enzyme) or as mixtures of two or more enzymes (e.g. cogranulates). Enzymes in liquid detergents can be stabilized by various techniques as for example disclosed in U.S. Pat. No. 4,261,868 and U.S. Pat. No. 4,318,818.

The detergent compositions of the present invention may additionally comprise one or more biologically active peptides such as swollenin proteins, expansins, bacteriocins and peptides capable of binding to stains.

D. Other ingredients

The detergent compositions of the invention may contain alkali metal, preferably sodium, carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate polymer, or sodium silicate. One preferred powder structurant is fatty acid soap, suitably present in an amount of from 1 to 5 wt %.

The detergent compositions according to the present invention may also comprise from 0.001% to 10%, more preferably from 0.01% to 2%, more preferably from 0.05% to 1% by weight of polymeric dye transfer inhibiting agents. Said polymeric dye transfer inhibiting agents are normally incorporated into detergent compositions in order to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash. Especially suitable polymeric dye transfer inhibiting agents are polyamine N-oxide polymers, copolymers of N-vinylpyrrolidone and N-vinylimidazole, polyvinylpyrrolidone polymers, polyvinyl-oxazolidones and polyvinylimidazoles or mixtures thereof.

Soil release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. No. 4,116,885 and U.S. Pat. No. 4,711,730 and EP-A-272 033.

Other materials that may be present in detergent compositions of the invention include sodium silicate; anti-redeposition agents such as cellulosic polymers; inorganic salts such as sodium sulphate, lather control agents or lather boosters as appropriate, enzyme stabilizers, corrosion inhibitors, dyes, coloured speckles, perfumes, suds depressants, germicides, anti-tarnishing agents, opacifiers, optical brighteners, foam controllers, and fabric softening compounds. This list is not intended to be exhaustive.

Detergent compositions of the invention may be prepared by any suitable method. Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP-A-340 013, EP-A-367 339, EP-A-390 251 and EP-A-420 317 (Unilever).

Several types or classes of substances one may wish to oxidize are indicated below:

A. Polypyrrolic Structures

Polypyrrolic structures, often coordinated to a metal, form one class of coloured substances which occur in stains. Examples are heme or haematin in blood stain, chlorophyll as the green substance in plants, e.g. grass or spinach. Another example of a metal-free substance is bilirubin, a yellow breakdown product of heme.

B. Tannins, Polyphenols

Tannins are polymerised forms of certain classes of polyphenols. Such polyphenols are catechins, leuantocyanins, etc. (P. Ribéreau-Gayon, Plant Phenolics, Ed. Oliver & Boyd, Edinburgh, 1972, pp.169–198). These substances can be conjugated with simple phenols like e.g. gallic acids. These polyphenolic substances occur in tea stains, wine stains, banana stains, peach stains, etc. and are notoriously difficult to remove.

C. Carotenoids (G.E. Bartley et al., The Plant Cell (1995), Vol 7, 1027–1038). Carotenoids are the coloured substances which occur in tomato (lycopene, red), mango (β-carotene, orange-yellow). They occur in food stains (tomato) which are notoriously difficult to remove, especially on coloured fabrics, when the use of chemical bleaching agents is not advised.

D. Anthocyanins (P. Ribéreau-Gayon, Plant Phenolics, Ed. Oliver & Boyd, Edinburgh, 1972, 135–169). These substance are the highly coloured molecules which occur in many fruits and flowers. Typical examples, relevant for stains, are berries, but also wine. Anthocyanins have a high diversity in glycosidation patterns.

E. Maillard Reaction Products

Upon heating of mixtures of carbohydrate molecules in the presence of protein/peptide structures, a typical yellow/brown coloured substance arises. These substances occur for example in cooking oil and are difficult to remove from fabrics.

F. Dyes in Solution

For the prevention of dye transfer from a coloured piece of fabric to other garments during the wash, it valuable to specifically bleach the dye molecules in the wash solution. Several types of fabric dyes are used, and can therefore be envisaged to be a target for the oxidation process: e.g. sulphur dyes, vat dyes, direct dye, reactive dyes and azoic dyes.

The invention will now be further illustrated in the following, non-limiting Example.

EXAMPLE 1

Bleaching of Tomato Stains.

The potential of the organic compounds to bleach stains was assessed by washing cotton swatches soiled with coloured material from tomato's. This material was prepared by acetone extraction of the chromophores from concentrated tomato paste. For the preparation of the stains, the colored acetone solution was applied to cotton swatches The bleaching experiments were performed in small 250 ml containers, to which 15 ml of wash solution was added. The organic bleaching compound was dosed at 200 pM. Two compounds used were: oxalic acid bis(2-phenylhydrazide), and oxalic acid bis(2-m-tolylhydrazide). The following formulation was used as wash solution (2 g/liter):

| Detergent Composition: | |
|---|---|
| Linear Alkylbenzene Sulphonate | 24% |
| Sodium Tripolyphosphate | 14.5% |
| Soda ash | 17.5% |
| Sodium silicate | 8.0% |
| SCMC | 0.37% |
| Blue pigment | 0.02% |
| Moisture/salts | 34.6% |

The swatches were washed during 30 minutes, at 30° C. After the wash, the swatches were tumble-dried and the reflectance spectra were measured using a Minolta spectrometer. The color differences between the swatch before and after the wash data were expressed in the CIELAB L*a*b* color space. In this color space, L* indicates lightness and a* and b* are the chromaticity coordinates. Color differences between two swatches are expressed as ΔE, which is calculated from the following equation:

$$\Delta E=\sqrt{\Delta L^2+\Delta a^2+\Delta b^2}$$

The results, as ΔE values, are shown in Table 1 below:

| | |
|---|---|
| No organic compound added | ΔE = 16.45 |
| Wash with oxalic acid bis(2-phenylhydrazide) | ΔE = 20.39 |
| Wash with oxalic acid bis (2-m-tolylhydrazide) | ΔE = 25.42 |

As can be seen from the ΔE values, the bleaching of the tomato stain is improved in the presence of the organic compounds.

What is claimed is:

1. Oxidation process wherein an oxidisable substance is reacted with:

(a) a compound having the formula:

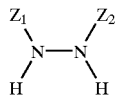

wherein $Z_1$ is an optionally substituted aromatic or heteroaromatic group, and $Z_2$ is an electron withdrawing group selected from the group consisting of optionally substituted alkyl/(hetero)aryl-, -sulfone, -sulfoxide, -sulfonate, -carbonyl, -oxalyl, -amidoxalyl, -hydrazidoxalyl, -carboxyl and esters salts thereof, -amidyl, -hydrazidyl, and nitrile, and (b) molecular oxygen, in the absence of peroxidase.

2. Process according to claim 1, wherein the compound has the formula:

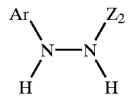

wherein Ar is selected from the group consisting of phenyl, phenyl substituted with halogen(s), alkoxy, alkyl, (alkyl) amino substituents, pyridinyl, alkyl-pyridinyl, and furanyl.

3. Process according to claim 1, wherein the compound has the formula:

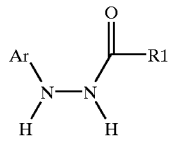

wherein Ar is as defined before and R1 is an optionally substituted alkyl, oxyalkyl, aryl, arylhydrazide or oxyaryl group.

4. Process according to claim 2, wherein the compound has the formula:

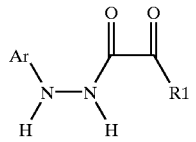

wherein Ar is as defined before and R1 is an optionally substituted alkyl, oxyalkyl, aryl, arylhydrazine or oxyaryl group.

5. Process according to claim 1, wherein the compound has the formula:

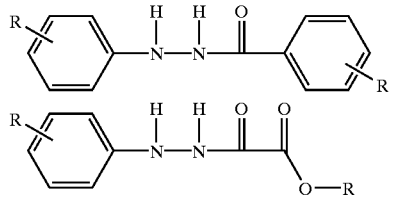

-continued

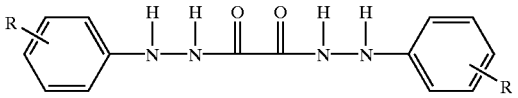

with R representing one or more substitutions independently selected from hydrogen, halogen(s), alkoxy, alkyl, (alkyl) amino, carbonate, carbonate ester, sulphonate, and sulfonamide.

6. Process according to claim 1, wherein the compound is selected from the group consisting of:

2'-phenylbenzohydrazide;
2'-m-tolylbenzohydrazide;
2'-p-tolylbenzohydrazide;
2'-o-tolylbenzohydrazide;
Ethyl [2-(m-tolyl)]hydrazide oxalate;
Ethyl [2-(p-tolyl)]hydrazide oxalate;
Ethyl [2-(o-tolyl)]hydrazide oxalate;
Oxalic acid bis(2-phenylhydrazide);
Oxalic acid bis(2-m-tolylhydrazide) and
Oxalic acid bis(2-o-tolylhydrazide).

7. Process according to claim 1, wherein said process is for bleaching stains on fabrics.

8. Process according to claim 1, wherein the substance which is to be oxidized is selected from the group consisting of porphyrin derived structures, tannins, polyphenols, carotenoids, anthocyanins, maillard reaction products and textile dyes.

9. A composition for oxidizing substances, comprising a compound having the formula:

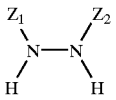

wherein $Z_1$ is an optionally substituted aromatic or heteroaromatic group, and $Z_2$ is an electron withdrawing group selected from the group consisting of optionally substituted alkyl/(hetero)aryl- -sulfone, -sulfoxide, -sulfonate, -carbonyl, -oxalyl, -amidoxalyl, -hydrazidoxalyl, -carboxyl and esters salts thereof, -amidyl, -hydrazidyl, and nitrile, said composition being essentially free from peroxidase.

10. A composition for oxidizing substances according to claim 9, wherein the compound has the formula:

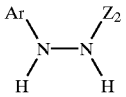

wherein Ar is selected from the group consisting of phenyl, phenyl having halogen(s), alkoxy, alkyl, (alkyl)amino substituents, pyridinyl, alkyl-pyridinyl, and furanyl.

11. A composition for oxidizing substances according to claim 10, wherein the compound has the formula:

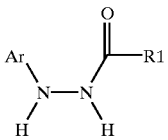

wherein Ar is as defined before and R1 is an optionally substituted alkyl, oxyalkyl, aryl, arylhydrazide or oxyaryl group.

12. A composition for oxidizing substances according to claim 10, wherein the compound has the formula:

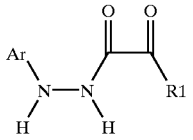

wherein Ar is as defined before and R1 is an optionally substituted alkyl, oxyalkyl, aryl, arylhydrazine or oxyaryl group.

13. A composition for oxidizing substances according to claim 9, wherein the compound has the formula:

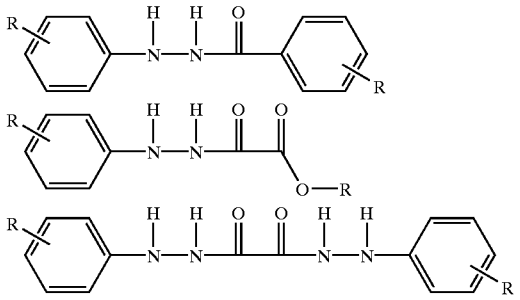

with R representing one or more substitutions independently selected from hydrogen, halogen(s), alkoxy, alkyl, (alkyl) amino, carbonate, carbonate ester, sulphonate, and sulfonamide.

14. A composition for oxidizing substances according to claim 9, wherein the compound is selected from the group consisting of:

2'-phenylbenzohydrazide;
2'-m-tolylbenzohydrazide;
2'-p-tolylbenzohydrazide;
2'-o-tolylbenzohydrazide;
Ethyl [2-(m-tolyl)]hydrazide oxalate;
Ethyl [2-(p-tolyl)]hydrazide oxalate;
Ethyl [2-(o-tolyl)]hydrazide oxalate;
Oxalic acid bis(2-phenylhydrazide);
Oxalic acid bis(2-m-tolylhydrazide) and
Oxalic acid bis(2-o-tolylhydrazide).

15. Composition according to claim 9, wherein the substance which is to be oxidized is selected from the group consisting of porphyrin derived structures, tannins, polyphenols, carotenoids, anthocyanins and maillard reaction products.

16. A detergent composition for stain bleaching and/or anti dye-transfer, comprising: (a) a surfactant and (b) a compound having the formula:

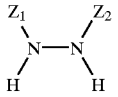

wherein $Z_1$ is an optionally substituted aromatic or heteroaromatic group, and $Z_2$ is an electron withdrawing group, selected from the group consisting of optionally substituted alkyl/(hetero)aryl- -sulfone, -sulfoxide, -sulfonate, -carbonyl, -oxalyl, -amidoxalyl, -hydrazidoxalyl, -carboxyl and esters salts thereof, -amidyl, -hydrazidyl, and nitrile, said composition being essentially free from peroxidase.

17. A detergent composition for stain bleaching and/or anti dye-transfer according to claim 16, wherein the compound has the formula:

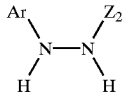

wherein Ar is selected from the group consisting of phenyl, phenyl substituted with halogen(s), alkoxy, alkyl, (alkyl) amino substituents, pyridinyl, alkyl-pyridinyl, and furanyl.

18. A detergent composition for stain bleaching and/or anti dye-transfer according to claim 17, wherein the compound has the formula:

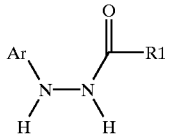

wherein Ar is as defined above and R1 is an optionally substituted alkyl, oxyalkyl, aryl, arylhydrazide or oxyaryl group.

19. A detergent composition for stain bleaching and/or anti dye-transfer according to claim 17, wherein the compound has the formula:

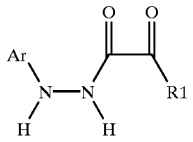

wherein Ar is as defined above and R1 is an optionally substituted alkyl, oxyalkyl, aryl, arylhydrazine or oxyaryl group.

20. A detergent composition for stain bleaching and/or anti dye-transfer according to claim 16, wherein the compound has the formula:

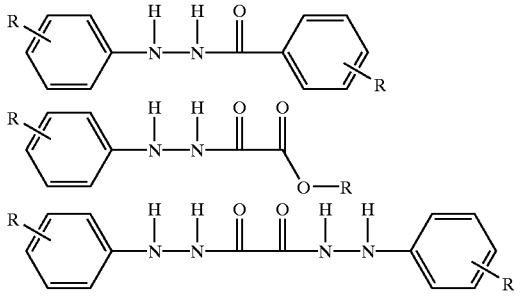

with R representing one or more substitutions independently selected from hydrogen, halogen(s), alkoxy, alkyl, (alkyl) amino, carbonate, carbonate ester, sulphonate, and sulfonamide.

21. A detergent composition for stain bleaching and/or anti dye-transfer according to claim 16, wherein the compound is selected from the group consisting of:

2'-phenylbenzohydrazide;
2'-m-tolylbenzohydrazide;
2'-p-tolylbenzohydrazide;
2'-o-tolylbenzohydrazide;

Ethyl [2-(m-tolyl)]hydrazide oxalate;
Ethyl [2-(p-tolyl)]hydrazide oxalate;
Ethyl [2-(o-tolyl)]hydrazide oxalate;
Oxalic acid bis(2-phenylhydrazide);
Oxalic acid bis(2-m-tolylhydrazide) and
Oxalic acid bis(2-o-tolylhydrazide).

* * * * *